US006613445B2

(12) United States Patent
Sangeeta et al.

(10) Patent No.: US 6,613,445 B2
(45) Date of Patent: Sep. 2, 2003

(54) METAL SLURRY COATINGS ON SUBSTRATES, AND RELATED ARTICLES

(75) Inventors: D. Sangeeta, Cincinatti, OH (US); Howard John Farr, Blue Ash, OH (US)

(73) Assignee: General Electric Company, Niskayuna, NY (US)

( * ) Notice: Subject to any disclaimer, the term of this patent is extended or adjusted under 35 U.S.C. 154(b) by 61 days.

(21) Appl. No.: 10/046,673

(22) Filed: Jan. 16, 2002

(65) Prior Publication Data

US 2002/0094445 A1 Jul. 18, 2002

Related U.S. Application Data

(62) Division of application No. 09/378,956, filed on Aug. 23, 1999, now Pat. No. 6,485,780.

(51) Int. Cl.[7] ..... B32B 15/02; B32B 15/20

(52) U.S. Cl. ..... 428/553; 428/557; 428/559; 428/650; 428/652; 428/670; 428/672; 428/937; 428/938; 428/941

(58) Field of Search ..... 428/553, 557, 428/559, 650, 652, 670, 672, 937, 938, 941

(56) References Cited

U.S. PATENT DOCUMENTS

| | | | | |
|---|---|---|---|---|
| 3,102,044 A | * | 8/1963 | Joseph | 427/380 |
| 3,741,791 A | | 6/1973 | Maxwell et al. | |
| 3,979,273 A | * | 9/1976 | Panzera et al. | 428/670 |
| 4,009,146 A | | 2/1977 | Cork et al. | |
| 4,241,113 A | | 12/1980 | Martinengo et al. | |
| 4,542,048 A | | 9/1985 | Nickola et al. | |
| 5,366,765 A | | 11/1994 | Milaniak et al. | |
| 5,547,770 A | | 8/1996 | Meelu et al. | |
| 5,650,235 A | | 7/1997 | McMordie et al. | |
| 5,658,614 A | | 8/1997 | Basta et al. | |
| 5,807,428 A | | 9/1998 | Bose et al. | |
| 5,824,366 A | | 10/1998 | Bose et al. | |
| 5,897,966 A | | 4/1999 | Grossklaus, Jr. et al. | |
| 5,922,409 A | | 7/1999 | McMordie et al. | |
| 6,395,406 B1 | * | 5/2002 | Sangeeta | 428/650 |

FOREIGN PATENT DOCUMENTS

| | | |
|---|---|---|
| DE | 19824792 | 2/1999 |
| WO | 9942633 | 8/1999 |

OTHER PUBLICATIONS

XP002153291—Derwent Publication, Japanese Patent Abstract JP 60 103177, Jun. 1985.
Patent Abstracts of Japan, 10152781, Jun. 1998.
Patent Abstracts of Japan, 01092355, Apr. 1989.
Patent Abstracts of Japan, 61159577, Jul. 1986.
European Search Report, Application No. EP 00 30 6795, Nov. 2000.
"Ceramic Slurry Coatings for Advanced Heat Engines", by L. Kamo et al., Adiabatics, Inc., Columbus, IN, Preceedings of the International Thermal Spray Conference & Exposition, Orlando, FL, 5/28–6/5/92, pp. 45–49.

* cited by examiner

*Primary Examiner*—Robert R. Koehler
(74) *Attorney, Agent, or Firm*—Paul J. DiConza; Patrick K. Patnode

(57) ABSTRACT

A method for forming a metal-containing layer on a substrate is disclosed. A slurry of the metal is first deposited on the substrate; followed by heating to remove volatile material from the slurry, and to form a layer of the metal. In another embodiment, a slurry of aluminum is deposited over the slurry of the metal, before or after the metal has been heat-treated to some degree. A diffusion heat treatment results in a coating which includes the noble-metal aluminide compound. Related articles are also disclosed.

2 Claims, No Drawings

METAL SLURRY COATINGS ON SUBSTRATES, AND RELATED ARTICLES this application is a division of application Ser. No. 09/378,956, filed Aug. 23, 1999 now U.S. Pat. No. 6,485, 780, which is hereby incorporated by reference in its entirety.

BACKGROUND OF THE INVENTION

This invention relates generally to coatings for substrates. More particularly, it is directed to methods for applying protective coatings on substrates employed in high temperature.

High-performance alloys are often the materials of choice for various components which are exposed to high-temperature environments. As an example, turbine blades and other parts of turbine engines are often formed of nickel-based superalloys because they need to maintain their integrity at temperatures of at least about 1000° C. –1150° C. In many instances, the alloys have to be covered with protective coatings which provide greater resistance to corrosion and oxidation at high temperatures, as compared to the alloy itself.

A common example of a protective coating material for turbine engine blades is a metal-aluminide, such as platinum aluminide. This type of material is usually deposited in several steps. For instance, the platinum is electroplated onto the blade, using P-salt or Q-salt electroplating solutions. In the second step, the platinum layer is diffusion-treated with aluminum vapor to form platinum aluminide.

When such a protective coating becomes worn or damaged, it must be carefully repaired, since direct exposure of the underlying substrate to excessive temperature may eventually cause the component to fail and adversely affect various parts of the engine. The coatings often have to be repaired several times during the lifetime of the component. The "overhaul" of the protective coating usually involves complete removal of the coating, followed by the application of a new coat of the material.

In many situations, certain portions (i.e., "local areas") of the protective coating require repair, while the remainder of the coating remains intact. As an example, portions of a platinum-aluminide protective coating may become depleted in aluminum—especially when the component is exposed to an oxidizing atmosphere for an extended period of time. In the case of superalloy substrates, loss of aluminum from the adjacent protective coating can be detrimental to the integrity of the superalloy since, under desirable circumstances, the coating provides thermal oxidation protection at elevated use temperatures.

For selective, local repair, the traditional process of completely removing the platinum-aluminide coating is often inefficient. Such a process requires multiple electroplating steps, followed by an aluminiding process, such as, pack aluminiding. In addition to being labor-intensive and time-consuming, the traditional repair process can sometimes be detrimental to the component. For example, the repeated stripping and re-coating of protective layers may damage the substrate, "eating" into its thickness and thereby changing critical dimensions of the component.

Thus, new techniques for applying metal-aluminide coatings to substrates would be welcome in the art. The techniques should be efficient and not labor-intensive. They should also be useful for coating selected portions of the substrate, such as, only those sections which re repair. Moreover, the new techniques should preserve the integrity of the substrate surface.

SUMMARY OF THE INVENTION

In one aspect, this invention is directed to a method for forming a metal-containing layer on a substrate, comprising the following steps:

(a) depositing a slurry of the metal on the substrate; and (b) heating the metal slurry under temperature and time conditions sufficient to remove substantially all volatile material from the slurry, and to form a layer which comprises the metal.

The slurry of the metal is deposited on the substrate by various techniques, such as spraying. For purposes of this invention, the metal slurry layer is separate from aluminum metal or the aluminum slurry layer. It may be applied in multiple applications, with heat treatments between each application, to remove the volatile components. The layer of metal is then usually subjected to a diffusion heat treatment. A typical metal used in this process is platinum. The substrate is often a superalloy, such as, a nickel-based superalloy used in a turbine engine.

In another embodiment, a slurry of aluminum is deposited over the slurry of the metal, before or after the metal has been heat-treated to some degree. A diffusion heat treatment after the deposition of the aluminum results in a coating which comprises a metal-aluminide compound. The coating may also comprise a compound based on aluminide, metal and at least one metallic element in the substrate.

In still another alternative, the deposition of the metal slurry is followed by a volatile-removing heat treatment, and then a diffusion heat treatment. Aluminum is then deposited by a diffusion heat treatment of aluminum vapor.

The invention is also directed to a method for repairing a damaged or worn metal-aluminide coating applied over a substrate, comprising the following steps:

(i) removing the damaged or worn coating from a selected area on the substrate; and then (ii) applying additional coating material over the selected area, by (I) depositing aluminum and a slurry of the metal on the selected area, in place of the coating removed in step (i); and (II) heating the aluminum and the slurry under temperature and time conditions sufficient to remove substantially all volatile material from the deposited aluminum and slurry, and to form a layer of metal-aluminide on the selected area. The aluminum is usually in the form of an aluminum slurry deposited on the selected area after the deposition of the slurry of the metal (such as, platinum). This method is a convenient technique for quickly and effectively repairing platinum-aluminide coatings, such as those which are not easily accessible for other repair techniques.

Related articles of manufacture are also described below, along with further details regarding the various features of this invention.

DETAILED DESCRIPTION OF THE INVENTION

A variety of materials, includingm, but not limited to, ceramics, composites, metals, or metal alloys can be used as the substrate for the present invention. The term "metal-based" in reference to substrates disclosed herein refers to those which are primarily formed of metal or metal alloys, but which may also include some non-metallic components, such as ceramics, intermetallic phases, or intermediate phases. In one embodiment, the substrate is a heat-resistant alloy, for example a superalloy which typically has an operating temperature of up to about 1000–1150° C. Superalloys are described in various references, such as U.S. Pat. Nos. 5,399,313 and 4,116,723, both incorporated herein by reference. High temperature alloys are also generally described in Kirk-Othmer's *Encyclopedia of Chemical Technology*, 3rd Edition, Vol. 12, pp. 417–479 (1980), and Vol 15, pp. 787–800 (1981). Illustrative nickel-base superalloys are designated by the trade names Inconel ®, Nimonic®, Rene®(such as, Rene® 80–, Rene® 95 alloys), and Udimet®. The type of substrate can vary widely, but it is often in the form of a jet engine part, such as a turbine blade, bucket, a nozzle guide, nozzle, vane, airfoil, or a combustor liner. As another example, the substrate may be the piston head of a diesel engine, or any other surface requiring a protective coating. In some instances, the substrate thickness can be quite small, for example less than about 0.25 cm.

The choice of metal for the present invention depends on various factors, such as the type of component being coated and the environment in which the component will be used. The prevailing cost of the particular metal may also be of considerable importance. Usually, the metal is selected from the group consisting of gold, platinum, and palladium. Platinum is often preferred if the coating is being applied on various turbine engine components, such as the blades. The metal may be used in various forms, such as particles and flakes, with particles being used most often. The size of the particles will depend in part on the particular metal, as well as the manner in which the slurry is being applied to the substrate. The particles usually have an average diameter of less than about 25 microns, and very often, less than about 10 microns.

According to one embodiment, a slurry of the metal, including a noble metal, is first deposited on the substrate. As used herein, the term "slurry" is generally meant to embrace a solid-particle suspension in liquid. In addition to the metal itself, the slurry often contains a liquid carrier. Selection of a carrier will depend on various factors, such as: the solubility of the metal and other optional additives in the carrier; the evaporation rate required during subsequent processing; the effect of the carrier on the adhesion of the slurry coating to a substrate; the carrier's ability to wet the substrate to modify the rheology of the slurry composition; as well as handling requirements; cost; availability; and environmental/safety concerns. Those of ordinary skill in the art can select the most appropriate carrier by considering these factors. Non-limiting examples of carriers include water; alcohols such as ethanol and isopropanol; terpene and terpene-derivatives such as terpineol; halogenated hydrocarbon solvents such as methylene chloride and tetrachloromethane; and compatible mixtures of any of these substances. Terpene derivatives and other solvents with relatively high densities are often preferred, in view of their ability to readily maintain the metal particles in suspension. Lower-density solvents are sometimes used with thickeners or anti-settling agents.

The amount of liquid carrier employed is usually the minimum amount sufficient to keep the solid components of the slurry in suspension. Amounts greater than that level may be used to adjust the viscosity of the slurry composition, depending on the technique used to apply the composition to a substrate. In general, the liquid carrier will comprise about 30% by volume to about 70% by volume of the entire slurry composition. Additional amounts of the liquid carrier may be used to adjust slurry viscosity prior to application of the coating.

The slurry of the metal may also contain one or more binders and other additives. Non-limiting examples include poly(vinyl butyral), polyethylene oxide, and various acrylics, phosphates and chromates, as well as other water-based or solvent-based organic materials. The amount of binder present will vary considerably, but it is usually in the range of about 0.1% by weight to about 10% by weight of the entire slurry composition.

Most of the components used in the slurry coating composition are well known in areas of chemical processing and ceramics processing. Many are described in the Kirk-Othmer *Encyclopedia of Chemical Technology*, 4th Edition, Vol. 5, pp. 610–613. Examples include thickening agents, dispersants (which break up flocs in a slurry); deflocculants, anti-settling agents, plasticizers, emollients, lubricants, surfactants and anti-foam agents. In general, lubricants, thickeners, or emollients may each be used at a level in the range of about 0.01% by weight to about 10% by weight, and more preferably, about 0.1% by weight to about 2.0% by weight, based on the weight of the entire slurry composition. Those skilled in the art can determine the most effective level for any of the other additives, without undue effort.

Many of the platinum slurries are commercially available. They are sometimes referred to in the art as "platinum inks". Non-limiting examples include A-4338, A-3788, and A-6101XA, all available from the Engelhard Corporation of East Newark, N.J. Another example is Platinum Ink #6926, also available from Engelhard, which includes micron-sized platinum particles suspended in terpene. Some of these inks are described in U.S. Pat. Nos. 4,396,480; 5,306,411, and 5,569,633, which are incorporated herein by reference. Suitable platinum slurries are also available from Johnson Matthey, Inc.

The metal slurry may be applied to the protective coating surface by a variety of techniques known in the art. (See, for example, the Kirk-Othmer *Encyclopedia of Chemical Technology*, 4th Edition, Vol. 5, pp. 606–619; as well as *The Technology of Paints, Varnishes and Lacquers*, edited by C. Martens, Reinhold Book Corporation, 1968. The slurries can be slip-cast, brush-painted, dipped, sprayed, flow-coated, roll-coated, or spun-coated onto the substrate surface, for example.

Spraying (such as, air spraying or airless spraying) is often the easiest way to apply the slurry coating onto the substrate. The viscosity of the coating for spraying can be frequently adjusted by varying the amount of liquid carrier used, for example. Spraying equipment and parameters for-this technique are known in the art, such as, see the *Encyclopedia of Chemical Processing and Design*, Vol. 53, p. 45 et seq.; and *Surface Coatings—Paints and their Applications*, Vol. 2, Tafe Educational Books, 1984. One example of an air-spray gun is the Paasche 62 sprayer, which operates at about 35–40 psi, and forms a 1–2 inch (2.5–5.1 cm) spray-fan pattern, when the spray gun is kept at about 5–12 inches (12–30 cm) from the substrate (stand-off distance). A wide variety of paint sprayers can be used. Usually, the slurry is applied in multiple passes (such as, back and forth) of the spray gun.

In preferred embodiments, the layer of metal slurry is heat-treated after being applied to the substrate (and prior to the optional deposition of the aluminum component). This particular heat treatment can be referred to as an "evaporation step" or "evaporation stage". The choice of heating technique is usually not critical. A conventional oven is frequently employed. The appropriate time/temperature schedule for heating the slurry layer will depend on various factors, such as the desired thickness for the coating; the particular rheological characteristics of the coating composition; the evaporation rates for the volatile components in the slurry composition, and the shrinkage rate of the coating as the volatile components evaporate. (The volatility of components in the slurry composition can be determined by a variety of techniques, such as differential thermal analysis (DTA) and thermal gravimetric analysis (TGA)).

Sometimes, the slurry is gradually heated to a temperature approximately equal to the boiling point of the least-volatile component. The temperature can be maintained at that level until substantially all of the volatile materials have been evaporated. If the temperature is raised too quickly, the rapid evaporation of volatile components can lead to bubbling, which may result in coating defects. When removing volatile components, the heating is usually done in an air atmosphere.

Frequently, the slurry of the metal includes volatile components which have a considerable range of boiling points. In those instances, it is often desirable to evaporate the volatile components at two or more heating levels, for example, a first heating level for the lower-boiling components, and a second heating level for the higher-boiling components. Use of the multiple evaporation levels appears to enhance the green strength of the applied layer. As a general example, the slurry could first be heated at a temperature in the range of about 100° C. to about 200° C. for about 5 minutes to about 120 minutes, to remove lower-boiling components like alcohols. The temperature could then be raised to a second level of heating at a temperature in the range of about 300° C. to about 400° C. for about 5 minutes to about 120 minutes, to remove (by evaporation or burn-out) higher-boiling components like many of the organic binders. In general, longer heating times compensate to some extent for lower temperatures, while higher temperatures compensate to some extent for shorter time periods. (The maximum heating temperature should remain below that which would result in considerable oxidation of the substrate). Those of skill in the art will be able to determine the most appropriate time and temperature regime for a given slurry system.

In some preferred embodiments, the layer of metal slurry is deposited in at least two applications. The use of the thinner "sub-layers" appears to result in greater green strength for the overall layer after removal of the volatiles, while also enhancing adhesion of the layer to the substrate. The number of applications will depend in part on the composition of the slurry and the desired thickness of the overall layer. For an overall metal thickness (after removal of the volatile components) in the range of about 1 micron to about 10 microns, two applications of the slurry are often desirable. In preferred embodiments, the volatile-removing heat treatment (or multiple heat treatments) is carried out after each of the applications of slurry. However, it may sometimes be possible to avoid the heat treatment until after the last application of the slurry, such as, when the overall coating is very thin.

In some embodiments, the metal layer (i.e., the coating that results from the removal of volatiles from the slurry) is diffusion heat-treated prior to the optional application of aluminum. Diffusion heat treatments for metal-containing layers are known in the art. The primary factors involved in selecting the most appropriate time and temperature for this treatment are (1) the time required to form various aluminum phases, such as bimetallic and trimetallic aluminides; and 2) the desired thickness of the diffusion layer. Usually, the diffusion heat treatment is carried out at a temperature in the range of about 975° C. to about 1200° C. for about 30 minutes to about 8 hours. In some preferred embodiments, the diffusion heat treatment is carried out at a temperature in the range of about 975° C. to about 100° C. for about 60 minutes to about 4 hours. The diffusion heat treatment may be carried out in an inert gas atmosphere, such as, argon or nitrogen, or in a vacuum. Sometimes, the inert gas is mixed with hydrogen.

As mentioned above, aluminum may optionally be deposited on the metal-coated substrate as a slurry. Aluminum slurries are known in the art and commercially available. The material is often a dispersion of aluminum metal powder, such as, from about 30 to about 50 wgt % aluminum, in an aqueous solution. The aluminum powder usually has an average particle size of less than about 10 microns. Various other ingredients may be present. For example, one or more binders may be used, such as chromium salts (such as, dichromate), phosphate salts (such as, aluminum phosphate), or molybdate salts. The slurry may also contain various forms of silicon. For example, an alkali metal silicate may be used to lower the curing temperature of the slurry. Modifiers which permit curing of the slurry into water-insoluble form at reduced temperatures may also be included. Examples include alkanol amines. One non-limiting example of a suitable aluminum-based slurry for the present invention is Alseal 625®, from Coatings for Industry, Inc. Some other suitable slurries are described in U.S. Pat. Nos. 4,319,924; 4,289,652; 3,248,251; 3,248,250; 3,248,249; and Belgian Patent No. 825,180, all of which are incorporated herein by reference.

The aluminum slurry may be applied over the metal-coated substrate by any of the techniques described above. As in the case of the metal slurry, spraying is often the preferred technique. The viscosity of the slurry can be adjusted for effective spraying by the addition of an appropriate solvent, such as, water. Other spray parameters can also be selected by those of ordinary skill in the art. The aluminum slurry may be deposited in one application, but is often deposited as sub-layers in at least two applications. As in the case of the metal slurry, the number of applications will depend in part on the composition of the slurry and the desired thickness of the overall layer. In some preferred embodiments, about 2 to about 4 applications of the slurry are deposited.

Moreover, the aluminum slurry is usually heat-treated after the application of each sub-layer, to remove a portion of the aqueous component, such as, water, while removing substantially all of the other volatile constituents, such as, the binders. For the aluminum slurries generally described above, the heat treatment is usually carried out in air at a temperature in the range of about 70° C. to about 130° C. for about 60 minutes to about 120 minutes. In general, longer heating times compensate to some extent for lower temperatures, while higher temperatures compensate to some extent for shorter time periods. In some embodiments, a heat treatment is not carried out until after all of the sub-layers are applied, or is carried out after some (but not all) of the sub-layer applications. Elimination of some of the heat treatments may be desirable if each sub-layer is very thin, or if very short processing times are required. However, it is usually preferred that a heat treatment take place after each of the sub-layer depositions, to improve the green strength of the aluminum layer, while also ensuring the removal of substantially all of the volatiles.

In preferred embodiments, an additional heat treatment is carried out to cure the aluminum coating. This treatment can be carried out in air, vacuum, or an inert gas environment, or an environment which includes an air/inert gas mixture. As used herein, "curing" of the aluminum coating is accomplished when (1) any volatile materials (including the aqueous components) are substantially evaporated or "burned out"; and (2) the coating becomes densified, with higher green strength. The most appropriate curing temperature will depend on various factors, such as the specific components contained in the "green" coating, as well as its thickness. Usually, the curing temperature will be in the range of about 200° C. to about 300° C., for about 1 minute to about 30 minutes. As in the case of the other heat treatments, an adjustment in cure time can permit an adjustment in cure temperature. The cure temperature can be achieved by gradually raising the heating temperature from that used in the prior heat treatment, or by rapidly raising the heating temperature.

The aluminum layer is then subjected to a diffusion heat treatment sufficient to diffuse the aluminum into the metal material. A layer of metal-aluminide is thereby formed, and is sometimes referred to as a "diffusion layer". As mentioned above, diffusion heat treatments are well-known in the art. Related information can be found in the Kirk-Othmer *Encyclopedia of Chemical Technology*, 4th Edition, Vol. 19, pp. 371–312 (1996); and Vol. 21, pp. 102–103 (1997). The diffusion heat treatment for aluminum is usually carried out at a temperature in the range of about 975° C. to about 1200° C. for about 60 minutes to about 8 hours. In some preferred embodiments, the diffusion heat treatment is carried out at a temperature in the range of about 975° C. to about 1100° C. for about 60 minutes to about 6 hours. As in the case of the diffusion heat treatment for the metal, treatment for aluminum may be carried out in an inert gas atmosphere, such as, argon or nitrogen, or in a vacuum. Sometimes, the inert gas is mixed with hydrogen.

It should be understood that the present invention includes various alternatives in regard to the diffusion heat treatment, when both the metal and aluminum are being deposited. For example, the use of a single diffusion heat treatment after the deposition of the aluminum is possible, i.e., omitting the diffusion heat treatment after the deposition of the metal. Alternatively, multiple diffusion heat treatments can be carried out, such as, one after the deposition of the metal, and one after the deposition of the aluminum. Those of skill in the art can determine the most appropriate heat treatment-regimen, based in part on the factors described herein.

The thickness of the metal-aluminide layer will depend in large part on the desired end use of the component containing the substrate. For a turbine engine component, the thickness will usually be in the range of about 10 microns to about 200 microns, and preferably, in the range of about 10 microns to about 30 microns.

In another embodiment of this invention, the aluminum is deposited on the metal-coated substrate by a diffusion heat treatment of aluminum vapor. Such a process is sometimes referred to as "vapor aluminiding" or "vapor aluminizing", and is known in the art. Conventional sources of aluminum vapor can be employed, such as, activated precursors like ammonium fluoride and alumina. In general, the vapor aluminiding treatment is carried out according to the conditions used for the diffusion treatment of the aluminum slurry layer described previously, for example about 975° C. to about 1200° C. for about 30 minutes to about 8 hours. As is understood in the art, the diffusion process often results in interdiffusion between aluminum, the metal, and sometimes, the underlying substrate, such as, the nickel-based material.

Variations in the vapor aluminiding process may be employed. For example, a pack-aluminiding process may be used, in which the metal-coated substrate is immersed within a mixture or pack containing the aluminum source, filler material, and a halide energizer. At temperatures which are usually in the range of about 700–750° C., reactions within the mixture yield an aluminum-rich vapor which condenses onto the substrate surface. The substrate can then be subjected to a diffusion heat treatment sufficient to diffuse the aluminum into the metal material, as described previously.

Other exemplary techniques which can be used to diffuse aluminum into the metal coat include pack cementation, fluidized-bed techniques, "out-of-the-pack" processes, chemical vapor deposition, electrophoresis, and sputtering. Those of skill in the area of refractory coatings are familiar with the various pertinent details regarding each of these processes.

In still another embodiment for forming a metal-aluminide coating, the aluminum is, again, in the form of a slurry. The aluminum slurry is first combined with the slurry of the metal to form a mixture. The mixture is then deposited on the substrate by one of the techniques described above, such as, spraying.

In some instances, a single slurry which contains both the metal component and the aluminum component can be prepared, using a solvent or solvent mixture which is compatible with each component. Alternatively, the metal and aluminum components could each be suspended in a solvent or solvent mixture, and the resulting mixtures could then be combined.

Very often, commercial aluminum slurries are aqueous-based, while metal slurries are organic solvent-based. In such an instance, it is important that the two slurries be somewhat "compatibilized" with each other, prior to their combination and deposition on the substrate. Those skilled in the art are familiar with different techniques for compatibilizing different types of mixtures. As an example, a combination of the slurries could be diluted with a large amount of a solvent which is at least partially compatible with both slurries, such as, an alcohol-based solvent. Alternatively, additives which function as compatibilizing agents could be added to the combination of slurries.

For some of the embodiments described above, the final heat treatment, i.e., the diffusion-type heat treatment, may result in the formation of various compounds in the deposited layer. For example, when a metal slurry is deposited on the substrate, followed by the deposition of aluminum (i.e., by slurry or by vapor aluminiding, for example), and following one or more diffusion heat treatments, some reaction of the deposited material with the substrate metal can occur. Thus, various compounds may be formed. The resulting layer may comprise nickel aluminide, platinum-aluminide compounds, and platinum-nickel-aluminide compounds.

Another embodiment of this invention is directed to a method for repairing a damaged or worn metal-aluminide coating applied over a substrate. The metal-aluminide coating is usually platinum-aluminide. In the case of gas turbine engines, coating repair may be required during the manufacture and assembly of the engine, or during its overhaul after a length of service. In the first step, the damaged coating is removed from a selected area on the substrate by conventional procedures, for example using chemical cleaning and stripping techniques.

The additional or replacement coating material is then applied over the selected area, by (I) depositing aluminum and a platinum slurry on the selected area, in place of the damaged coating; and then (II) heating the aluminum and the platinum slurry under temperature and time conditions sufficient to remove substantially all volatile material from the deposited aluminum and slurry, and to form a layer of platinum-aluminide on the selected area. Details regarding relevant processes and materials are provided above. The platinum slurry can be applied readily by spraying or other techniques. The aluminum component is preferably deposited as a slurry, but it could alternatively be deposited by some form of vapor deposition. The component being repaired is usually inserted into a conventional oven or a tube oven (for semi-continuous processes), to remove the volatile components. The adequacy of the heat treatments can be determined in part by examination of the coatings after they are cooled, in regard to appearance, adhesion, and other well-known physical characteristics.

This repair process is very useful for applying durable "patch coats" on various substrates. Moreover, the process does not require a great deal of equipment, as in the case of chemical vapor deposition (CVD), physical vapor deposition (PVD), or metal-organic chemical vapor deposition (MOCVD) systems. Repairs can be conveniently made to surfaces which are often not easily accessible, such as, cavities within turbine engine components.

Another aspect of the invention is directed to an article, comprising:

(i) a substrate;

(ii) a slurry of a metal applied over the substrate; and (iii) a slurry of aluminum applied over the substrate.

As described previously, removal of the volatile components from the slurries, along with a diffusion heat treatment, results in a substrate coated with a metal-aluminide layer. The substrate is usually a superalloy, and the metal-aluminide is often platinum aluminide.

EXAMPLES

The following examples are merely illustrative, and should not be construed to be any sort of limitation on the scope of the claimed invention.

EXAMPLE 1

The substrate was button-shaped (2.5 cm diameter), and formed from a nickel-based superalloy. A surface of the substrate was grit-blasted, ultrasonically cleaned in isopropyl alcohol, and then dried. A platinum slurry from Engelhard was used in this example. The slurry had a product designation of A6101XA, and contained about 65% by weight platinum, in the form of fine particles having an average diameter of less than about 8 microns. The slurry also contained terpineol solvent, as well as various organic binders. The slurry was diluted with sufficient ethanol to form a 50% platinum slurry/50% ethanol composition.

The platinum slurry was then deposited on the substrate, using a Paasche 52 air-spray gun, operating at a pressure of about 30–40 psi. The gun-to-substrate distance was about 12 inches (30.5 cm). The as-deposited coating was baked in air at 150° C. for 15 minutes, using a standard oven, and then at 300° C. for 30 minutes, to remove the binders.

A second application of the platinum slurry was then applied by the spray device, and was followed by the same heat treatment. The coated substrate was then diffusion-treated in argon at 1000° C. for 30 minutes. The process was repeated several times for different superalloy buttons. In each instance, the platinum coatings were tightly bound to the substrate. The average thickness of the coatings was about 2.3 microns.

EXAMPLE 2

The platinum slurry used in Example 1 was again diluted by about 50% by weight in ethanol, and applied to a number of nickel-based superalloy buttons by spray coating, under conditions similar to those of Example 1. For each button, the as-deposited coating was baked at 400° C. for about 30 minutes, followed by a diffusion heat treatment at a temperature of about 900–1000° C. for about 30–60 minutes. In general, each of the resulting coatings was very smooth, and adhered tightly to the substrate. The coating thickness from button to button varied from about 2.5 microns to about 25 microns, and the thickness was very uniform for the thinner coatings.

EXAMPLE 3

The platinum slurry used in Example 1 was again deposited on the nickel-based substrate, using different sets of conditions. In one run, the dilution ratio was changed to 65% by weight ethanol/35% by weight platinum slurry. In other runs, the number of passes (i.e., with the sprayer) was varied, from about 5 to 10 passes per application of slurry. In another set of runs, the number of applications (i.e., spraying/baking cycles) was varied from one to three. Each run resulted in depositions of good quality. The thickness of the platinum deposit varied from about 1.9 to 4.3 microns.

The various substrates were then diffusion-treated at 900° C.–1100° C. under one of three atmospheric conditions: argon, an argon/hydrogen mixture, or a vacuum. The heating time was in the range of about 30 to 60 minutes. In each instance, the platinum coatings became metallurgically bonded to the substrate.

EXAMPLE 4

Example 1 was repeated, followed by the deposition of an aluminum slurry. The slurry was designated as Alseal 625®, and was obtained from Coatings for Industry, Inc. The slurry contained about 38% by weight aluminum, along with a silicone, a chromium salt and a ceramic binder. The slurry was then air-sprayed onto the platinum-coated substrate to provide a wet thickness of about 25–50 microns.

The slurry layer was then baked at 80° C. for 10 minutes in air. Two additional slurry layers (i.e., "sub-layers") were then sprayed over the substrate. After the deposition of each sub-layer, a heat treatment was carried out at 80° C. for 10 minutes in air. The substrate was then cured at 260° C. for 10 minutes in air, followed by a diffusion heat treatment in argon at 1093° C. for 4 hours. This resulted in a platinum-aluminide coating which had a high level of adhesion to the substrate. A series of platinum-coated substrates were diffusion-coated with aluminum in this manner. The average thickness of the platinum-aluminide coatings was in the range of about 50–100 microns.

EXAMPLE 5

Example 2 was repeated for another series of buttons, and was then followed by the spray-deposition of aluminum slurry (using the Alseal 625® material) on the buttons. The deposition was carried out in one application (i.e., one layer). The layer of slurry was then baked at 300° C., followed by a diffusion heat treatment (in argon) for about 60 minutes at 1095° C. The diffused coatings on the samples were uniform, and the coating thickness varied between about 50 microns to 100 microns.

EXAMPLE 6

Example 5 was repeated, with a variation in procedure. In this instance, the platinum layer was not diffusion heat-treated (i.e., as in the case of Example 2), until after the deposition of the aluminide slurry. The resulting coatings had a substantially uniform thickness, and adhered tightly to the substrate.

EXAMPLE 7

Example 2 was repeated, and was followed by a conventional vapor-aluminiding procedure carried out at about 1000° C.–1100° C. for about 4 hours. Again, the resulting coatings were uniform, and adhered tightly to the substrate. Moreover, the coatings had microstructures which were similar to the microstructures of prior art coatings applied by conventional procedures, i.e., electroplated platinum followed by vapor aluminiding.

Some of the preferred embodiments have been set forth in this disclosure for the purpose of illustration. However, the foregoing description should not be deemed to be a limitation on the scope of the invention. Accordingly, various modifications, adaptations, and alternatives may occur to one skilled in the art without departing from the spirit and scope of the claimed inventive concept.

All of the patents, articles, and texts mentioned above are incorporated herein by reference.

What is claimed:

1. An article, comprising:

(i) a substrate;

(ii) a slurry of a metal applied over the substrate; and (iii) a slurry of aluminum applied over the metal slurry and the substrate.

2. The article of claim 1, wherein component (ii) is a slurry comprising platinum, and the substrate is a component of a turbine engine.

* * * * *